US012751489B2

(12) United States Patent
Gonzalez Florez et al.

(10) Patent No.: US 12,751,489 B2
(45) Date of Patent: Oct. 6, 2026

(54) AEROSOL-GENERATING ARRANGEMENT FOR GENERATING AN INHALABLE AEROSOL FROM AN AEROSOL-FORMING LIQUID

(71) Applicant: Philip Morris Products S.A., Neuchatel (CH)

(72) Inventors: Ana Isabel Gonzalez Florez, Preverenges (CH); Özgür Özsun, Kilchberg (CH); Enrico Turrini, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 450 days.

(21) Appl. No.: 18/549,766

(22) PCT Filed: Mar. 10, 2022

(86) PCT No.: PCT/EP2022/056207
§ 371 (c)(1),
(2) Date: Sep. 8, 2023

(87) PCT Pub. No.: WO2022/189578
PCT Pub. Date: Sep. 15, 2022

(65) Prior Publication Data

US 2024/0237729 A1 Jul. 18, 2024

(30) Foreign Application Priority Data

Mar. 12, 2021 (EP) ..... 21162433

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/44* (2020.01); *A24F 40/465* (2020.01); *A24F 40/485* (2020.01)

(58) Field of Classification Search
None
See application file for complete search history.

(56) References Cited

U.S. PATENT DOCUMENTS

2015/0272216 A1 10/2015 Dai et al.
2016/0331039 A1 11/2016 Thorens et al.
(Continued)

FOREIGN PATENT DOCUMENTS

CN 1205849 A 1/1999
CN 107645914 A 1/2018
(Continued)

OTHER PUBLICATIONS

International Search Report and Written Opinion issued May 17, 2022 in PCT/EP2022/056207, filed on Mar. 10, 2022, 16 pages.
(Continued)

*Primary Examiner* — Cynthia Szewczyk
(74) *Attorney, Agent, or Firm* — Oblon, McClelland, Maier & Neustadt, L.L.P.

(57) ABSTRACT

An aerosol-generating arrangement for generating an aerosol from an aerosol-forming liquid is provided, the aerosol-generating arrangement including: a liquid reservoir configured to store aerosol-forming liquid; a capillary liquid conveyer configured to convey aerosol-forming liquid from the liquid reservoir via a reservoir orifice to an evaporation section of the capillary liquid conveyer outside the liquid reservoir; and an air duct configured to pass an airflow past the evaporation section, the liquid reservoir being a volume-compensating liquid reservoir configured to counteract capillary imbibition of the capillary liquid conveyer, the air duct
(Continued)

including an ejector portion including an air jet generating member and an expansion zone downstream the air jet generating member, and the air jet generating member being arranged and configured to generate an air jet in the airflow through the air duct causing a drop of static air pressure in a vicinity of the evaporation section.

20 Claims, 5 Drawing Sheets

(51) Int. Cl.

| | |
|---|---|
| ***A24F 40/44*** | (2020.01) |
| ***A24F 40/465*** | (2020.01) |
| ***A24F 40/485*** | (2020.01) |

(56) References Cited

U.S. PATENT DOCUMENTS

| | | | |
|---|---|---|---|
| 2017/0071249 | A1 | 3/2017 | Ampolini et al. |
| 2017/0172210 | A1 | 6/2017 | Bright et al. |
| 2017/0173278 | A1 | 6/2017 | Buchberger |
| 2018/0160735 | A1 | 6/2018 | Borkovec et al. |
| 2020/0022417 | A1 | 1/2020 | Atkins et al. |

FOREIGN PATENT DOCUMENTS

| | | | | |
|---|---|---|---|---|
| CN | 108348003 | A | 7/2018 | |
| CN | 111067144 | A | 4/2020 | |
| EP | 0 893 071 | A | 7/1999 | |
| EP | 2 319 334 | A1 | 5/2011 | |
| EP | 2 460 422 | A1 | 6/2012 | |
| EP | 2 554 208 | A1 | 2/2013 | |
| EP | 3 162 229 | A1 | 5/2017 | |
| JP | 2015-504653 | A | 2/2015 | |
| JP | 2018-520666 | A | 8/2018 | |
| RU | 2 719 204 | C2 | 4/2020 | |
| WO | WO-2013083638 | A1 * | 6/2013 | ..... A61L 9/03 |
| WO | WO 2014/153515 | A1 | 9/2014 | |
| WO | WO 2016/096497 | A1 | 6/2016 | |
| WO | WO 2016/124740 | A1 | 8/2016 | |
| WO | WO 2016/194076 | A1 | 12/2016 | |
| WO | WO 2018/211035 | A1 | 11/2018 | |
| WO | WO-2019162372 | A1 * | 8/2019 | ..... A24F 40/30 |
| WO | WO 2020/142523 | A1 | 7/2020 | |
| WO | WO 2021/228909 | A1 | 11/2021 | |
| WO | WO 2022/117717 | A1 | 6/2022 | |
| WO | WO 2022/117719 | A1 | 6/2022 | |
| WO | WO 2022/117720 | A1 | 6/2022 | |
| WO | WO 2022/117721 | A1 | 6/2022 | |
| WO | WO 2022/117722 | A1 | 6/2022 | |

OTHER PUBLICATIONS

Russian Decision to Grant issued Mar. 12, 2025 in Russian Patent Application No. 2023125972/03 (with English Translation), 16 pages.

Japanese Office Action issued on Nov. 25, 2025 in Japanese Patent Application No. 2023-555740 (with unedited computer-generated English translation), 10 pages.

Office Action dated Apr. 30, 2026 issued in corresponding Chinese patent application No. 202280018789.6 (with English translation).

* cited by examiner

AEROSOL-GENERATING ARRANGEMENT FOR GENERATING AN INHALABLE AEROSOL FROM AN AEROSOL-FORMING LIQUID

The present disclosure relates to an aerosol-generating arrangement for generating an inhalable aerosol from an aerosol-forming liquid which is capable of releasing volatile compounds upon heating. The invention further relates to an aerosol-generating article, an aerosol-generating device and an aerosol-generating system comprising such an aerosol-generating arrangement.

Arrangements for generating inhalable aerosols from aerosol-forming liquids are generally known from prior art. For example, such arrangements may comprise a reservoir for storing the aerosol-forming liquid and a capillary liquid conveyer for conveying the liquid from the reservoir to an evaporation section of the liquid conveyer outside the reservoir. There, the liquid may be vaporized by heating the evaporation section. The vaporized liquid is exposed to air flowing past the evaporation section such as to form an aerosol which may be subsequently drawn out, for example, via a mouthpiece. Typically, the airflow is caused by user's puff.

Using a capillary liquid conveyer to draw an aerosol-forming liquid from a reservoir to an evaporation section of the conveyer outside the reservoir comes with problems inherent to the processes governing the physics of capillary action. In particular, this concerns the uncontrolled imbibition of the capillary liquid conveyer which may cause undesired leakage problems and variations in the amount of liquid available in the evaporation section. The latter may in turn lead to undesired variations in the amount of aerosol that is generated by heating the liquid in the evaporation section.

Therefore, it would be desirable to have an aerosol-generating arrangement comprising a liquid reservoir and a capillary liquid conveyer with the advantages of prior art solutions, whilst mitigating their limitations. In particular, it would be desirable to have an aerosol-generating arrangement comprising a liquid reservoir and a capillary liquid conveyer which provides an enhanced control of the liquid flow from the reservoir through the capillary liquid conveyer to the evaporation section.

According to the present invention, there is provided an aerosol-generating arrangement for generating an aerosol from an aerosol-forming liquid. The aerosol-generating arrangement comprises a liquid reservoir for storing aerosol-forming liquid and a capillary liquid conveyer for conveying aerosol-forming liquid from the liquid reservoir via a reservoir orifice to an evaporation section of the liquid conveyer outside the reservoir. The aerosol-generating arrangement further comprises an air duct for passing an airflow past the evaporation section. The liquid reservoir is a volume compensating liquid reservoir which is configured to counteract capillary imbibition of the capillary liquid conveyer. The air duct comprises an ejector portion including an air jet generating member and an expansion zone downstream the air jet generating member. The air jet generating member is arranged and configured to generate an air jet in the airflow through the air duct causing a drop of the static air pressure in the vicinity of the evaporation section.

According to the invention it has been found that uncontrolled imbibition of the capillary liquid conveyer can be prevented by using a volume compensating liquid reservoir which counteracts the imbibition of the capillary liquid conveyer. For this, the volume compensating liquid reservoir is configured to provide a restoring force which holds back capillary imbibition, that is, which counteracts the capillary suction and the liquid static pressure that would otherwise cause leakage. Details and specific examples of the volume compensating liquid reservoir will be described further below. In order to provide an alternative mechanism for the liquid transport other than uncontrolled imbibition, the present invention proposes to induce an appropriate drop of static pressure in the vicinity of the evaporation section which counteracts the restoring force of the volume compensating liquid reservoir and which thus causes liquid to be drawn from the reservoir through the capillary liquid conveyer to the evaporation section. According to the invention, the pressure drop is induced by an air jet generated in an ejector portion of the air duct including an air jet generating member that exploits Bernoulli's principle. Details and specific examples of the air jet generating member will be described further below. The physical mechanism behind the static pressure drop as seen from a microscopic view is as follows: Fast moving air particles in the air jet ejecting into open atmosphere downstream the air jet generating member collide with air particles that are randomly and slowly wandering around. Collision pushes the "stationary" air particles further away leading to local pressure drops which in turn results in more air particles being drawn into the air jet from the surroundings. Thus, the air jet leaves behind a partial a vacuum which is felt as a pressure drop inside the liquid conveyer causing a pressure gradient along the capillary liquid conveyer that draws liquid out of the reservoir through the capillary liquid conveyor to the evaporation section. The air jet further causes aerosol-forming liquid vaporized at the evaporation section to be drawn into the airflow and subsequently to be mixed with air in the expansion zone downstream the air jet generating member such as to form an aerosol.

Together the volume compensating liquid reservoir and the air jet generating member form a well-balanced system which on the one hand suppresses uncontrolled imbibition and thus provides leakage protection, in particular when the system is out of use. On the other hand, this system allows for an enhanced control over the liquid flow rate through the capillary liquid conveyer by exploiting Bernoulli's principle in the airflow passing through the air duct in use. Controlling the liquid flow rate through the capillary liquid conveyer, preferably in combination with controlling the temperature of the heating process, in turn allows for enhanced control over the aerosol generation rate.

Preferably, the airflow driven pressure drop and thus the flow of liquid through the capillary liquid conveyer is triggered/triggerable by a user inhalation. For this, the aerosol-generating arrangement is configured such that the airflow passing through the air duct is induced by a user inhalation, that is, by a user taking a puff at an outlet of the air duct, such as a mouthpiece, downstream the ejector portion. In doing so, the user's puff induces a low pressure at the outlet which in turn causes air to enter the air duct at an inlet of the air duct upstream the ejector portion. In particular, by varying the intensity of the user inhalation the liquid flow rate from the reservoir through the capillary liquid conveyer to the evaporation section may be specifically controlled by the user. Vice versa, when a user is not taking a puff and thus when no air is flowing through the air duct, there is no pressure drop in the vicinity of the evaporation section. In this situation, the restoring force provided by the volume compensating liquid reservoir dominates over the capillary action and thus prevents capillary imbibition.

In general, the restoring force used to counteract capillary imbibition may be realized in different ways. For example, the volume compensating liquid reservoir may comprise a flexible bag for storing the aerosol-forming liquid and a low-pressure chamber sealingly enclosing the flexible bag, wherein the interior of the flexible bag is in fluid communication with the capillary liquid conveyer. That is, like the pleurae of the pleural sac that surrounds each lung in the human body, the flexible bag is sealed in a surrounding chamber, wherein an internal pressure in the sealed space between the flexible bag and the surrounding chamber is lower than ambient pressure, in particular atmospheric pressure. Thus, the low pressure counteracts the capillary suction of the liquid conveyer that is in fluid communication with the interior of the flexible bag. Accordingly, as used herein, the term "low-pressure" refers to a pressure below ambient pressure, in particular atmospheric pressure.

In particular, the pressure within the low-pressure chamber acting on the exterior of the flexible bag preferably is lower than ambient pressure, in particular atmospheric pressure, minus the sum of the static liquid pressure and the capillary pressure at an upstream end of the reservoir orifice (or at an upstream end of the capillary liquid conveyer, where the capillary liquid conveyer has a varying capillary cross section along the direction of fluid flow through the liquid conveyer, see below). Advantageously, this prevents liquid from leaking out of the reservoir when the aerosol-generating arrangement is not in use. When a pressure drop being larger than the sum of the static liquid pressure and the capillary pressure is imposed externally in the vicinity of the evaporation section as described above, the pressure within the low-pressure chamber beats the downstream pressure. As a consequence, a pressure gradient is generated in a downstream direction along the capillary liquid conveyer that draws liquid out of the flexible bag through the capillary liquid conveyer to the evaporation section. Upon disappearance of the external pressure drop, liquid remaining inside the capillary liquid conveyer is pushed back into the flexible bag by ambient pressure, in particular atmospheric pressure, until the system finally reaches an equilibrium state. Due to the liquid extraction, the flexible bag collapses by a volume equal to that of the liquid extracted from the reservoir and ultimately evaporated at the evaporation section.

Preferably, the flexible bag is made from plastic, for example, polyvinyl chloride, polypropylene, polyethylene, ethylene vinyl acetate. As used herein, the term "flexible bag" refers to a bag the walls of which cannot resist deformation. That is, the walls of the flexible bag are non-rigid. As the flexible bag is configured to store aerosol-forming liquid therein, flexible bag is fluid-impermeable, that is, the walls of the flexible bag are fluid-impermeable.

In contrast, the low-pressure chamber preferably comprises rigid walls. That is, the low-pressure chamber preferably is a rigid-wall chamber. Due to this, the low-pressure chamber can maintain the low pressure inside and resist deformation, both from inside as well as from outside. Like the flexible bag, the walls of the low-pressure chamber are fluid-impermeable. For example, the walls of the low-pressure chamber may be made of plastic, in particular a silicone, PP (polypropylene), PE (polyethylene) or PET (polyethylene terephthalate).

According to another example, the volume compensating liquid reservoir may comprise a rigid-wall chamber comprising at least one breather hole. The breather hole may have a size enabling aerosol-forming liquid in the liquid reservoir to form a meniscus towards the interior of the liquid reservoir. That is, the breather hole preferably has a size within the capillary range. Due to this, the meniscus forming at the air-liquid interface can resist the surface tension that drives the liquid through the capillary liquid conveyer. This concept is based on the consideration that a fully closed rigid reservoir provides the highest resistance to volume change and can counteract capillary imbibition the most. In contrast, a reservoir open-to-atmosphere has the lowest resistance to volume change and thus can hardly prevent capillary imbibition. In between, when the reservoir comprises an opening the size of which is limited to within the capillary range, the resistance to volume change inversely scales with the size of the opening. Thus, the liquid tension on the walls of the breather hole creates a meniscus that deforms much like the shape of a bulged membrane, until the liquid tension at the reservoir orifice is balanced. This mechanism solely relies on the geometric parameters. Hence, a proper choice of the geometry of the reservoir orifice and the breather hole can ensure liquid being kept inside the reservoir orifice and the breather hole, thus preventing leaks.

For example, the breather hole may have a size in a range between 0.05 millimeter and 3 millimeter, in particular between 0.05 millimeter and 1.5 millimeter, preferably between 0.05 millimeter and 1 millimeter or between 0.1 millimeter and 0.7 millimeter or between 0.2 millimeter and 0.6 millimeter or between 0.3 millimeter and 0.6 millimeter, for example 0.5 millimeter.

Preferably, a cross-sectional area of the breather hole is smaller than a maximum cross-sectional area of the reservoir orifice. Advantageously, this allows for a smooth liquid flow.

Instead of merely relying on the elastic properties of the meniscus formed by the liquid in a breather hole, the hole may be covered with a resilient diaphragm that can deform under pressure load. This allows to make the meniscus stiffer by introducing elasticity which is the origin of the restoring force that holds back capillary imbibition. Using a resilient diaphragm may also allow to increase the size of the breather hole beyond capillary ranges. That is, the resilient diaphragm may form a wall member of the liquid reservoir. Hence, according to yet another example, the volume compensating liquid reservoir may comprise at least one resilient diaphragm forming a wall member of the liquid reservoir. Preferably, the wall member of the liquid reservoir formed by the resilient diaphragm is an outer wall member of the liquid reservoir being exposed to the interior of the liquid reservoir at its inside and to ambient pressure, in particular atmospheric pressure, at its outside. Preferably, any other wall member of the liquid reservoir—apart from the resilient diaphragm—is a rigid wall member.

The resilient diaphragm may have a Young's modulus (modulus of elasticity in tension) in a range between 1 MPa (Mega-Pascal) and 100 MPa (Mega-Pascal), in particular between 2 MPa (Mega-Pascal) and 50 MPa (Mega-Pascal), preferably between 2 MPa (Mega-Pascal) and 20 MPa (Mega-Pascal).

For example, the resilient diaphragm forming may be made of rubber, latex, silicone, chloroprene, polyisoprene, nitrile, or ethylene propylene.

As mentioned above, the volume compensating liquid reservoir comprises a reservoir orifice the capillary liquid conveyer is in fluid communication with. As used herein, the term "reservoir orifice" essentially denotes an outlet opening of the liquid reservoir. The reservoir orifice, in particular the size of the reservoir orifice, may be configured such that aerosol-forming liquid may form a meniscus inside the reservoir orifice. In particular, the reservoir orifice, in particular the size of the reservoir orifice, may be configured such that a position of the meniscus may be free to move axially inside the reservoir orifice. Here, the term "axially" refers to the direction of fluid flow through the reservoir orifice. The reservoir orifice may have a varying cross-section along the direction of fluid flow through the reservoir orifice in order to counteract the surface tension at the breather hole. In particular, a varying cross section between the interior of the liquid reservoir and the evaporation section allows to let the meniscus freely choose a new location inside the reservoir orifice upon disturbance of the static balance from equilibrium. At the same time, a varying cross section between the interior of the liquid reservoir and the evaporation section allows to minimize the risk of liquid flooding the heated zone or air bubbles entering the liquid reservoir by providing a large, continuous range of sizes that the meniscus can adapt before reaching either end of the reservoir orifice. Most notably, a varying cross section between the interior of the liquid reservoir and the evaporation section enables to keep and use the device in various orientations. This is because changes in the liquid static pressure due to a changing orientation of the device is counteracted by a liquid meniscus changing its position inside the varying cross section reservoir orifice. In particular, a cross-sectional area of the breather hole preferably is smaller than a largest cross-sectional area of the reservoir orifice. Preferably, the cross-section of the reservoir orifice tapers in an upstream direction, that is, towards the interior of the liquid reservoir. Accordingly, a smallest cross-sectional area of the reservoir orifice is located at an upstream side of the reservoir orifice, whereas a largest cross-sectional area of the reservoir orifice is located at a downstream side of the reservoir orifice. In addition or instead of having a reservoir orifice with a varying cross section, the capillary liquid conveyer may have a varying capillary cross section along the direction of fluid flow through the liquid conveyer. In particular, the capillary cross section of the capillary liquid conveyer may increase along the downstream direction of fluid flow through the liquid conveyer towards the heating section.

The liquid reservoir, or at least parts of the liquid reservoir, such as the walls (wall members) of the rigid-wall chamber or the low-pressure chamber, may comprise or may be made of a silicone or PP (polypropylene), PE (polyethylene) or PET (polyethylene terephthalate). It is also possible that the liquid reservoir, or at least parts of the liquid reservoir comprise or are made of heat resistant material(s), such as PEEK (polyether ether ketone), in order to provide good thermal stability. Where induction heating is used to heat the evaporation section of the capillary liquid conveyer (see below), in particular where at least the evaporation section is inductively heatable, any parts of the liquid reservoir preferably are made of inductively non-heatable material(s), that is, of electrically non-conductive and non-magnetic (non-ferromagnetic or non-ferromagnetic) material(s).

The aerosol-generating arrangement may be configured for single use or for multiple uses. In the latter case, the liquid reservoir may be a refillable liquid reservoir that is refillable with aerosol-forming liquid. In another configuration, the liquid conveyer and the air duct may be configured for multiple uses, for example, as permanent part of an aerosol-generating device, whereas the liquid reservoir may be configured for single use, for example, as a cartridge that is configured for use with the aerosol-generating device which the liquid conveyer and the air duct are part of. In any configuration, the aerosol-generating arrangement may further comprise an aerosol-forming liquid contained in liquid reservoir.

The main function of the capillary liquid conveyer is to convey aerosol-forming liquid from the liquid reservoir to a region outside the liquid reservoir. In addition to that, the capillary liquid conveyer may be used as a heat source for directly heating the aerosol-forming liquid. For this, the capillary liquid conveyer may be inductively heatable at least in the evaporation section. Preferably, the capillary liquid conveyer is inductively heatable in the evaporation section only. Thus, boiling of aerosol-forming liquid within the reservoir chamber can be prevented. Advantageously, this double function allows for a material saving and compact design of the capillary liquid conveyer without separate means for conveying and heating. In addition, there is a direct thermal contact between the heat source, that is, the liquid conveyer and the aerosol-forming liquid adhering thereto. Unlike in case of a separate heater in contact with the liquid conveyer, a direct contact between the liquid conveyer and a small amount of liquid advantageously allows for flash heating, that is, for a fast onset of evaporation. To this extent, the liquid conveyer may be considered to be a liquid-conveying susceptor arrangement.

To be inductively heatable, the capillary liquid conveyer may comprise or may be made of a susceptor material at least in the evaporation section or in the evaporation section only. It is also possible that the entire the capillary liquid conveyer comprises or is made of a susceptor material. That is, the entire capillary liquid conveyer may be inductively heatable.

As used herein, the term "inductively heatable" refers to a liquid conveyer comprising a susceptor material that is capable to convert electromagnetic energy into heat when subjected to an alternating magnetic field. Likewise, the term "susceptor material" refers to a material that is capable to convert electromagnetic energy into heat when subjected to an alternating magnetic field. This may be the result of at least one of hysteresis losses or eddy currents induced in the susceptor material, depending on the electrical and magnetic properties of the susceptor material. Hysteresis losses occur in ferromagnetic or ferrimagnetic susceptor materials due to magnetic domains within the material being switched under the influence of an alternating electromagnetic field. Eddy currents are induced in electrically conductive susceptor materials. In case of an electrically conductive ferromagnetic or ferrimagnetic susceptor material, heat is generated due to both, eddy currents and hysteresis losses.

In case the capillary liquid conveyer is inductively heatable, the aerosol-generating arrangement may further comprise an induction source configured and arranged to generate an alternating magnetic field at least at the position of the evaporation section. Preferably, the induction source configured and arranged to generate an alternating magnetic field substantially only at the position of the evaporation section, but hardly or not at the position of other sections of the capillary liquid conveyer. For example, the induction source may comprise an induction coil which is arranged substantially only around the evaporation section. Accordingly, when driving the induction coil with an AC current, the induction coil generates an alternating magnetic field which mostly penetrates the evaporation section, thus causing the capillary liquid conveyer to be heated locally in the evaporation section only. In contrast, due to the local heating, other sections of the capillary liquid conveyer are not heated (if comprising a susceptor material at all) but stay at temperatures below the vaporization temperature. Thus, boiling of aerosol-forming liquid within the liquid reservoir may be prevented.

As mentioned above, the induction source may comprise at least one induction coil. The at least one induction coil may be a helical coil or flat planar coil, in particular a pancake coil or a curved planar coil. The induction source may further comprise an alternating current (AC) generator. The AC generator may be powered by a power supply, such as battery. The AC generator is operatively coupled to the at least one induction coil. In particular, the at least one induction coil may be integral part of the AC generator. The AC generator is configured to generate a high frequency oscillating current to be passed through the at least one induction coil for generating an alternating magnetic field. The AC current may be supplied to the at least one induction coil continuously following activation of the system or may be supplied intermittently, such as on a puff by puff basis. Preferably, the induction source comprises a DC/AC converter including an LC network, wherein the LC network comprises a series connection of a capacitor and the inductor. The DC/AC converter may be connected to a DC power supply. The induction source preferably is configured to generate a high-frequency magnetic field. As referred to herein, the high-frequency magnetic field may be in the range between 500 kHz (kilo-Hertz) to 30 MHz (Mega-Hertz), in particular between 5 MHZ (Mega-Hertz) to 15 MHz (Mega-Hertz), preferably between 5 MHZ (Mega-Hertz) and 10 MHz (Mega-Hertz).

The induction source may be part of the aerosol-generating arrangement, in particular in case the entire aerosol-generating arrangement is part of an (stand-alone) aerosol-generating device, as will be described further below. Alternatively, the aerosol-generating arrangement (or at least a majority of the components of the aerosol-generating arrangement) may be part of an aerosol-generating article that is configured for use with an aerosol-generating device. Together, the aerosol-generating device and the aerosol-generating article form an aerosol-generating system. In this configuration, the induction source preferably is part of the aerosol-generating device, but not part of the aerosol-generating article. Notwithstanding that, one may consider the induction source to be part of the aerosol-generating arrangement, even though being separate from other components of the aerosol-generating arrangement. That is, one part of the aerosol-generating arrangement, in particular the air duct, the liquid reservoir and the capillary liquid conveyer, is part of the aerosol-generating article, while another part of the aerosol-generating arrangement, in particular the induction source, is part of the aerosol-generating device. Alternatively, one may consider the induction source not to be part of the aerosol-generating arrangement.

In case the liquid conveyer is inductively heatable, it may comprise a first susceptor material and a second susceptor material (at least in the evaporation section, in the evaporation section only or in the entire liquid conveyer). While the first susceptor material may be optimized with regard to heat loss and thus heating efficiency, the second susceptor material may be used as a temperature marker. For this, the second susceptor material preferably comprises one of a ferrimagnetic material or a ferromagnetic material. In particular, the second susceptor material may be chosen such as to have a Curie temperature corresponding to a predefined heating temperature. At its Curie temperature, the magnetic properties of the second susceptor material change from ferromagnetic or ferrimagnetic to paramagnetic, accompanied by a temporary change of its electrical resistance. Thus, by monitoring a corresponding change of the electrical current absorbed by the induction source it can be detected when the second susceptor material has reached its Curie temperature and, thus, when the predefined heating temperature has been reached. The second susceptor material preferably has a Curie temperature that is lower than 500 degree Celsius. In particular, the second susceptor material may have a Curie temperature below 350 degree Celsius, preferably below 300 degree Celsius, more preferably below 250 degree Celsius, even more preferably below 200 degree Celsius. For example, the second susceptor material may have a Curie temperature at about 220 degree Celsius. Preferably, the Curie temperature is chosen such as to be below the boiling point of the aerosol-forming liquid to be vaporized in order to prevent the generation of hazardous components in the aerosol.

Instead of heating the evaporation section itself via induction heating, it is also possible that the aerosol-generating arrangement comprises a heating element in thermal contact with or thermal proximity to the evaporation section. The heating element may be a resistive heating element or an inductive heating element. For example, the resistive heating element may be a wire heater, such as a heating coil, arranged around the evaporation section. The inductive heating element may be a susceptor element, such as susceptor plate next to the evaporation section or a susceptor coil arranged around the evaporation section which is inductively heatable in an alternating magnetic field generated by an induction source. As described further above, with regard to the inductively heatable liquid conveyer, the heating element in thermal contact with or thermal proximity to the evaporation section may be part of an (stand-alone) aerosol-generating device together with other components of the aerosol-generating arrangement. Likewise, the heating element may be part of an aerosol-generating device for use with an aerosol-generating article, wherein at least some of the other components or even all other components of the aerosol-generating arrangement, in particular the air duct, the liquid reservoir and the capillary liquid conveyer, are part of the aerosol-generating article.

In general, the capillary liquid conveyer may have any shape and configuration suitable to convey aerosol-forming liquid from the liquid reservoir to the evaporation section. Preferably, the evaporation section is or is located at a downstream end portion of the capillary liquid conveyer. In particular, the capillary liquid conveyer may comprise a wick element. The configuration of the wick element may be a stranded wire, a stranded rope of material, a mesh, a mesh tube, several concentric mesh tubes, a cloth, sheets of material, or a foam (or other porous solid) with sufficient porosity, a roll of fine metal mesh or some other arrangement of metal foil, fibers or mesh, or any other geometry that is appropriately sized and configured to carry out the wicking action as described herein.

As an example, the capillary liquid conveyer may comprise a filament bundle including a plurality of filaments. Preferably, the filament bundle is an unstranded filament bundle. In an unstranded filament bundle, the filaments of the filament bundle run next to each other without crossing each other, preferably along the entire length extension of the filament bundle. Likewise, the filament bundle may comprise a stranded portion, in which the filaments of the filament bundle are stranded. A stranded portion may enhance the mechanical stability of the filament bundle. Using filaments for conveying liquids is particularly advantageous because filaments inherently provide capillary action. Moreover, in a filament bundle, the capillary action is enhanced due to the narrow spaces formed between the pluralities of filaments when being bundled. In particular, this applies for a parallel arrangement of the filaments along which the capillary action is constant as the narrow spaces between the filaments do not vary along the parallel arrangement. For example, the filament bundle may comprise a parallel-bundle portion along at least a portion of its length extension in which the plurality of filaments may be arranged parallel to each other. The parallel-bundle portion may be arranged at one end portion of the filament bundle or between both end portions of the filament bundle. Alternatively, the parallel-bundle portion may extend along the entire length dimension of the filament bundle. The filament bundle may further comprise a fan-out portion at least at a downstream end portion of the filament bundle, which preferably corresponds or is part of the evaporation section. In the fan-out portion, the filaments diverge from each other. Such a fan-out portion may prove beneficial to facilitate the exposure of the vaporized aerosol-forming liquid into an air path and thus to facilitate the formation of an aerosol. It is possible, that the filament bundle may comprise two fan-out portions, one at each end portion of the filament bundle.

As another example, the capillary liquid conveyer may comprise at least one capillary channel. A mesh may be arranged across a downstream end of the capillary channel, in particular across an inner cross-section of the capillary channel at a downstream end of the capillary channel. The mesh may form at least a part of the evaporation section. Preferably, the size of the interstices of the mesh is chosen such that the aerosol-forming liquid can form a meniscus in the interstices of the mesh. The width of the interstices is preferably between 75 micrometer and 250 micrometer. The mesh may comprise a plurality of filaments, each filament having a diameter between 8 micrometer and 100 micrometer, preferably between 8 micrometer and 50 micrometer, and more preferably between 8 micrometer and 39 micrometer.

The mesh, in particular the filaments forming the mesh, may comprise or may be made of at least one susceptor material. Advantageously, this allows to use the mesh as a susceptor for inductively heating the aerosol-forming liquid at the downstream end of the capillary channel.

Alternatively, the downstream end of the capillary channel may be an open end (without anything being arranged the inner cross-section of the capillary channel at its downstream end). In this situation, the capillary channel preferably is inductively heatable at least in a downstream end portion. That is, the capillary channel may comprise or may be made of a susceptor material at least in a downstream end portion.

The capillary channel may be formed within a wall member of the aerosol-generating arrangement or by a capillary gap between several wall members of the aerosol-generating arrangement. For example, the capillary channel may be formed by a capillary gap between an inner wall member forming part of the air duct and an outer wall member forming an outer housing of the aerosol-generating arrangement.

It is also possible that the capillary liquid conveyer comprises at least one capillary tube. Like for the capillary channel, a mesh may be arranged at the downstream end of the capillary tube, in particular across the inner cross-section of the capillary tube at the downstream end of the capillary tube. Alternatively, the downstream end of the capillary tube may be an open end (without anything being arranged across the inner cross-section of the capillary tube at its downstream end). In this situation, the capillary tube preferably is inductively heatable at least in a downstream end portion. That is, the capillary tube may comprise or may be made of a susceptor material at least in a downstream end portion.

An inner cross-section of the capillary channel or the capillary tube may be constant along a direction of fluid flow through the capillary channel or the capillary tube, respectively. For example, an inner cross-section of the capillary channel or the capillary tube may be one of circular, oval, elliptical, rectangular or quadratic. An equivalent diameter of the inner cross-section of the capillary channel or the capillary tube may be in range between 0.1 millimeter and 3 millimeter, in particular between 0.1 millimeter and 1.5 millimeter, preferably between 0.1 millimeter and 1 millimeter. As used herein, the term "equivalent diameter" refers to the diameter of a circular area that has the same area as the cross-sectional area of the capillary channel or the capillary tube.

As yet another example, the capillary liquid conveyer may comprise two opposing plates forming a capillary gap in between. A width of the capillary gap between the two opposing plates in a direction normal to the two opposing plates may be in a range between 100 micrometers and 500 micrometers. Preferably, the width of the capillary gap is constant along a direction of fluid flow through the capillary gap. That is, the two opposing plates preferably are parallel to each other.

A gap holder may be arranged at a downstream end of the capillary liquid conveyer covering the gap between the two opposing plates. Advantageously, the gap holder serves to keep the two plates separate from each other and to close the gap at the downstream end of the two plates.

At least one of the two, preferably each of the two plates may comprise one or more perforations (through holes) at a downstream end portion of the capillary liquid conveyer, wherein the downstream end portion forms the evaporation section.

At least one of the two, preferably each of the two plates may comprise or may be made of a susceptor material at least at a downstream end portion of the capillary liquid conveyer. Due to this, the capillary liquid conveyer is capable to perform two functions, conveying and heating aerosol-forming liquid.

At least one of the two, preferably each of the two plates may be made of or may comprise a first material at a downstream end portion of the capillary liquid conveyer and a second material at an upstream end portion of the capillary liquid conveyer, wherein the first and the second material differ from each other. Advantageously, this may allow to have the downstream end portion of the capillary liquid conveyer inductively heatable and the upstream end portion of the capillary liquid conveyer inductively non-heatable.

Likewise, at least one of the two, preferably each of the two plates may be a two-part plate. In particular, two-part plate may comprise a first plate element at a downstream end portion of the capillary liquid conveyer comprising one or more perforations, and a second plate element at an upstream end portion of the capillary liquid conveyer being unperforated. For example, the first plate element may be mesh plate, whereas the second plate element may be a plate with a closed surface. Preferably, a material of the first plate element differs from a material of the second plate element. A material of the first plate element may be inductively heatable, that is, a susceptor material, and a material of the second plate element may be inductively non-heatable, that is, electrically non-conductive and non-magnetic.

The double-plate liquid conveyer is particularly advantageous with regard to induction heating. This is because the thickness of the plates which best matches the induction source can be chosen independently of the dimensions of the liquid conveyer in the direction of fluid flow. This independent choice allows to find an optimal balance between the rate of heat transfer and the liquid flow rate to the evaporation section. Furthermore, having the possible to make the capillary gap small allows to enhance the heating efficiency of the liquid (interdependently from the thickness of the plates) since a small gap allows for a rapid evaporation of the liquid substrate (flash heating) trapped between the susceptor plates. The flat geometry of the plates also facilitates to have the airflow past the evaporation section to be tangential. Advantageously, this enhances the effect of the static pressure drop at the evaporation section and thus the pressure gradient along the capillary liquid conveyer that draws liquid out of the liquid reservoir to the evaporation section.

As yet another example, the capillary liquid conveyer may comprise a capillary pipe having an open-ended downstream bell end forming the evaporation section. An inner cross-section of the capillary pipe may vary, in particular increase, along a direction of fluid flow through the capillary pipe. Advantageously, this makes a separate varying cross-section of the reservoir orifice unnecessary. For example, the inner cross-section of the capillary pipe may vary in a range between 0.1 millimeter and 5 millimeter, in particular between 0.1 millimeter and 3 millimeter, preferably between 0.1 millimeter and 1.5 millimeter.

The downstream bell end may be angled with respect to the remainder of the capillary pipe. For example, the downstream bell end may be angled by at least 45 degrees, in particular by at least 60 degrees, preferably by 90 degrees with respect to the remainder of the capillary pipe. Advantageously, this may allow to align an outlet of the downstream bell end (where the aerosol-forming liquid is evaporated in use) with respect to the air flowing past the evaporation section at the downstream bell end in use. In particular, the air jet generating member may be arranged and configured to generate an air jet that passes tangentially past an outlet of the downstream bell end. Preferably, the capillary pipe with the downstream bell end has an alphorn-like shape.

Preferably, the capillary pipe is inductively heatable at least at the downstream bell end. That is, at least at the downstream bell end the capillary pipe may comprise or may be made of a susceptor material. Having an inductively heatable bell-shaped evaporation section advantageously allows to enhance the heating efficiency of the evaporation section. The remaining sections of the capillary pipe may also be inductively heatable. Alternatively, the remaining sections of the capillary pipe may be inductively non-heatable. Thus, the heating capacity of the capillary liquid conveyer is decoupled from its liquid conveying capacity.

In general, the air duct may be formed by any structural means and may have any shape suitable to have air flowing past the evaporation section of the capillary liquid conveyer and preferably further into a user's mouth. As such, the evaporation section of the capillary liquid conveyer is exposed to the airflow the air duct. In particular, the evaporation section of the capillary liquid may be located within the air duct. This allows aerosol-forming liquid vaporized at the evaporation section to be drawn into the airflow and subsequently to be mixed with air in the expansion zone downstream the air jet generating member such as to form an aerosol.

The air duct may comprise an inlet upstream the ejector portion. The air duct may further comprise an outlet downstream the ejector portion. Preferably, the outlet of the air duct is part of a mouthpiece that can be taken into a user's mouth in order to take a puff. In doing so, the user's puff induces a low pressure at the outlet which in turn causes air to enter the air duct at the inlet of the air duct upstream the ejector portion.

The air jet generating member preferably is arranged and configured to generate an air jet that (in use) passes tangentially past an outlet or outlet portion of the capillary liquid conveyer. Advantageously, this enhances the effect of the static pressure drop at the evaporation section and thus the pressure gradient along the capillary liquid conveyer that draws liquid out of the liquid reservoir to the evaporation section.

The air jet generating member may comprise at least one jet nozzle. The jet nozzle may be arranged within a main airflow path through the air duct. Likewise, the jet nozzle may provide an additional airflow path entering a main airflow path at about the position of the evaporation section or upstream thereof. The nozzle may be pipe or tube having a varying cross-sectional area along the direction of fluid flow through the nozzle. In the nozzle, the velocity of fluid increases at the expense of its pressure energy and thus can be used to control the rate of flow, speed, direction, mass, shape, and/or the pressure of the fluid stream that emerges therefrom.

The air jet generating member may comprise at least one air path constriction in the air duct. As used herein, the term "air path constriction" refers to a constriction of the cross-section of the air path through the air duct. To this extent, a jet nozzle arranged within an airflow path through the air duct (as mentioned above) may also be considered as an air path constriction.

As an example, the air jet generating member may comprise an aperture plate forming the air path constriction. The aperture plate may be arranged within the airflow path of the air duct. The aperture plate may be a plate having at least one aperture, wherein the cross-section of the aperture is smaller than the cross-section of the air path through the air duct downstream and upstream the aperture, in particular proximately downstream and upstream the aperture.

As another example, the air duct may comprise a guide wall whose distance to a length axis of the capillary liquid conveyer is smaller at the position of the evaporation section than at other positions in the air duct upstream and downstream the evaporation section, in particular proximately downstream and upstream the evaporation section such that an air path constriction in the air duct is formed at the position of the evaporation section.

Likewise, the air duct may comprise a guide wall, wherein the air path constriction in the air duct is formed by a distance minimum between the guide wall and the capillary liquid conveyer at the position of the evaporation section.

The distance minimum between the guide wall and the capillary liquid conveyer at the position of the evaporation section may be formed by a lateral widening, in particular a fanning of the capillary liquid conveyer in the evaporation section. For example, the lateral widening or fanning of the capillary liquid conveyer may be formed by the bell end portion of the capillary pipe, details of which have been mentioned further above. Likewise, the lateral widening or fanning of the capillary liquid conveyer may be formed by a fan-out portion of a filament bundle-like liquid conveyer, details of which have also been mentioned further above.

The distance minimum between the guide wall and the capillary liquid conveyer at the position of the evaporation section may also be formed by a lateral indentation of the guide wall at the position of the evaporation section, wherein the lateral indentation of the guide wall points towards the capillary liquid conveyer.

As yet another example, the air duct may comprise a guide sleeve having a varying cross-section along the sleeve length axis, wherein the evaporation section is located within the guide sleeve at a minimum of the cross-section such as to form the air jet generating member. In particular, the guide sleeve may comprise a funnel portion upstream the minimum. In the funnel portion, the cross-section of the guide sleeve tapers, in particular convexly tapers, towards the minimum as seen in a downstream direction of the airflow through the air duct. The guide sleeve may further comprise a bulge portion downstream the minimum. In the bulge portion, the cross-section of the guide sleeve may first expand, in particular concavely expand, to maximum and subsequently taper, in particular concavely taper, as seen in a downstream direction of the airflow through the air duct. Preferably, the bulge portion forms the expansion zone.

In addition, the aerosol-generating arrangement may comprise a mouthpiece. As used herein, the term "mouthpiece" refers to an element that is placed into a user's mouth in order to directly inhale an aerosol from the article. The mouthpiece may be part of the air duct. Preferably, the mouthpiece comprises a filter. The filter may be used to filter out undesired components of the aerosol. The filter may also comprise an add-on material, for example, a flavor material to be added to the aerosol.

According to the present invention, there is also provided an aerosol-generating article for use with an aerosol-generating device, wherein the aerosol-generating article comprises an aerosol-generating arrangement according to the present invention and as described herein.

The aerosol-generating article may be an aerosol-generating article for single use or an aerosol-generating article for multiple uses. In the first case, the aerosol-generating article may be a consumable, in particular a consumable to be discarded after a single use. In the second case, the aerosol-generating article may be refillable. That is, the liquid reservoir may be refillable with aerosol-forming liquid. In any configuration, the aerosol-generating article may further comprise an aerosol-forming liquid contained in the liquid reservoir.

As used herein, the term "aerosol-forming liquid" relates to a liquid capable of releasing volatile compounds that can form an aerosol upon heating the aerosol-forming liquid. The aerosol-forming liquid is intended to be heated. The aerosol-forming liquid may contain both, solid and liquid aerosol-forming material or components. The aerosol-forming liquid may comprise a tobacco-containing material containing volatile tobacco flavor compounds, which are released from the liquid upon heating. Alternatively or additionally, the aerosol-forming liquid may comprise a non-tobacco material. The aerosol-forming liquid may further comprise an aerosol former. Examples of suitable aerosol formers are glycerin and propylene glycol. The aerosol-forming liquid may also comprise other additives and ingredients, such as nicotine or flavourants. In particular, the aerosol-forming liquid may include water, solvents, ethanol, plant extracts and natural or artificial flavors. The aerosol-forming liquid may be a water-based aerosol-forming liquid or an oil-based aerosol-forming liquid.

In addition, the aerosol-generating article may comprise a mouthpiece. As used herein, the term "mouthpiece" refers to a portion of the article that is placed into a user's mouth in order to directly inhale an aerosol from the article. Preferably, the mouthpiece comprises a filter. The filter may be used to filter out undesired components of the aerosol. The filter may also comprise an add-on material, for example, a flavor material to be added to the aerosol.

The article may have a simple design. The article may have a housing, which is preferably a rigid housing comprising a material that is impermeable to liquid. As used herein "rigid housing" means a housing that is self-supporting. The housing may comprise or may be made of one of PEEK (polyether ether ketone), PP (polypropylene), PE (polyethylene) or PET (polyethylene terephthalate). PP, PE and PET are particularly cost-effective and easy to mold.

Further features and advantages of the aerosol-generating article according to the present invention have already been described with regard to the aerosol-generating arrangement of the present invention and thus equally apply.

According to the invention, there is also provided an aerosol-generating system comprising an aerosol-generating article according to the present invention and as described herein, as well as an aerosol-generating device configured for use with the aerosol-generating article.

The aerosol-generating device may be configured to receive the aerosol-generating article. In particular, the aerosol-generating device may comprise a receiving cavity for receiving the aerosol-generating article therein. Likewise, the aerosol-generating device may be configured to be coupled to the aerosol-generating article, for example, by a screw-joint or a snap-joint or a bayonet joint.

As already mentioned further above, in such a system the aerosol-generating arrangement or at least a majority of the components of the aerosol-generating arrangement may be part of the aerosol-generating article. This holds in particular for the air duct, the liquid reservoir and the capillary liquid conveyer. That is, the air duct, the liquid reservoir and the capillary liquid conveyer are preferably part of the aerosol-generating article. In another configuration, the liquid conveyer and the air duct may be part of the aerosol-generating device, whereas the liquid reservoir may be part of the aerosol-generating article that is configured for use with the aerosol-generating device which the liquid conveyer and the air duct are part of. Notwithstanding that, one may consider the liquid conveyer and the air duct to be part of the aerosol-generating arrangement, even though being separate from other components of the aerosol-generating arrangement, such as the liquid reservoir. That is, one part of the aerosol-generating arrangement may be part of the aerosol-generating article, for example the liquid reservoir, while another part of the aerosol-generating arrangement, such as the air duct, the capillary liquid conveyer and—if present—the induction source, may be part of the aerosol-generating device. Where the evaporation section is inductively heatable, it is the aerosol-generating device which preferably comprises an induction source that is configured and arranged to generate an alternating magnetic field at the position of the evaporation section, when the aerosol-generating article is inserted in or coupled to the aerosol-generating device. Notwithstanding that, one may consider the induction source to be part of the aerosol-generating arrangement, even though being separate from other components of the aerosol-generating arrangement. That is, one part of the aerosol-generating arrangement is part of the aerosol-generating article, for example the air duct, the capillary liquid conveyer and preferably also the liquid reservoir, while another part of the aerosol-generating arrangement, in particular the induction source, is part of the aerosol-generating device. Alternatively, one may consider the induction source not to be part of the aerosol-generating arrangement. Details of the induction source have already been described with regard to the aerosol-generating arrangement of the present invention and thus equally apply.

As also mentioned further above, a heating element separate from the liquid conveyer may also be used for heating the evaporation section. The heating element may be or can be brought in thermal contact with or thermal proximity to the evaporation section. The heating element may be a resistive heating element or an inductive heating element. In particular in case of a resistive heating element, the heating element may be part of the aerosol-generating device.

The aerosol-generating device may further comprise a controller for controlling operation of the aerosol-generating system, in particular for controlling the heating operation. Furthermore, the aerosol-generating device may comprise a power supply providing electrical power used for heating the evaporation section of the capillary liquid conveyer. Preferably, the power supply is a battery such as a lithium iron phosphate battery. The power supply may have a capacity that allows for the storage of enough energy for one or more user experiences.

Further features and advantages of the aerosol-generating system according to the present invention have already been described with regard to the aerosol-generating arrangement and the aerosol-generating article of the present invention and thus equally apply.

According to the invention, there is also provided an aerosol-generating device for generating an aerosol from an aerosol-forming liquid, wherein the device comprises an aerosol-generating arrangement according to the present invention and as described herein. In particular, the aerosol-generating device is a stand-alone aerosol-generating device, that is, an aerosol-generating device which is not configured for use with an aerosol-generating article (consumable). Preferably, in this configuration the liquid reservoir is refillable.

Further features and advantages of the (stand-alone) aerosol-generating device according to the present invention have already been described with regard to the aerosol-generating arrangement of the present invention and thus equally apply. Also features and advantages described above with regard to the aerosol-generating device of the aerosol-generating system according to the present invention may be applied to the (stand-alone) aerosol-generating device.

The invention is defined in the claims. However, below there is provided a non-exhaustive list of non-limiting examples. Any one or more of the features of these examples may be combined with any one or more features of another example, embodiment, or aspect described herein.

Example Ex1: An aerosol-generating arrangement for generating an aerosol from an aerosol-forming liquid, wherein the aerosol-generating arrangement comprises a liquid reservoir for storing aerosol-forming liquid, a capillary liquid conveyer for conveying aerosol-forming liquid from the liquid reservoir via a reservoir orifice to an evaporation section of the liquid conveyer outside the reservoir, and an air duct for passing an airflow past the evaporation section, wherein the liquid reservoir is a volume compensating liquid reservoir configured to counteract capillary imbibition of the capillary liquid conveyer, and wherein the air duct comprises an ejector portion including an air jet generating member and an expansion zone downstream the air jet generating member, wherein the air jet generating member is arranged and configured to generate an air jet in the airflow through the air duct causing a drop of the static air pressure in the vicinity of the evaporation section.

Example Ex2: The aerosol-generating arrangement according to example Ex1, wherein the volume compensating liquid reservoir comprises a flexible bag for storing aerosol-forming liquid and a low-pressure chamber sealingly enclosing the flexible bag, wherein the interior of the flexible bag is in fluid communication with the capillary liquid conveyer.

Example Ex3: The aerosol-generating arrangement according to example Ex2, wherein the flexible bag is made from plastic, for example, polyvinyl chloride, polypropylene, polyethylene, ethylene vinyl acetate.

Example Ex4: The aerosol-generating arrangement according to any one of example Ex2 or example Ex3, wherein a pressure within the low-pressure chamber acting on the exterior of the flexible bag is lower than ambient pressure, in particular atmospheric pressure, minus the sum of the static liquid pressure and the capillary pressure at an upstream end of the reservoir orifice (or at an upstream end of the capillary liquid conveyer, where the capillary liquid conveyer has a varying capillary cross section along the direction of fluid flow through the liquid conveyer).

Example Ex5: The aerosol-generating arrangement according to any one of examples Ex2 to Ex4, wherein the low-pressure chamber comprises rigid walls.

Example Ex6: The aerosol-generating arrangement according to example Ex1, wherein the volume compensating liquid reservoir comprises a rigid-wall chamber comprising at least one breather hole having a size enabling aerosol-forming liquid in the liquid reservoir to form a meniscus towards the interior of the liquid reservoir.

The aerosol-generating arrangement according to example Ex6, wherein a cross-sectional area of the breather hole is smaller than a maximum cross-sectional area of the reservoir orifice.

Example Ex7: The aerosol-generating arrangement according to example Ex6 or example Ex7, wherein a cross-sectional area of the breather hole is smaller than a largest cross-sectional area of the reservoir orifice.

Example Ex8: The aerosol-generating arrangement according to example Ex1, wherein the volume compensating liquid reservoir comprises at least one resilient diaphragm forming an outer wall member of the liquid reservoir.

Example Ex9: aerosol-generating arrangement according to example Ex9, wherein any other wall member of the liquid reservoir—apart from the resilient diaphragm—is a rigid wall member.

Example Ex10: The aerosol-generating arrangement according to any one of example Ex9 or example Ex10, wherein the resilient diaphragm has a Young's modulus in a range between 1 MPa and 100 MPa, in particular between 2 MPa and 50 MPa, preferably between 2 MPa and 20 MPa.

Example Ex11: The aerosol-generating arrangement according to any one of the preceding examples, wherein a cross-section of the reservoir orifice tapers towards the interior of the liquid reservoir.

Example Ex12: The aerosol-generating arrangement according to any one of the preceding examples, wherein the capillary liquid conveyer comprises at least one capillary channel.

Example Ex13: The aerosol-generating arrangement according to example Ex13, wherein a mesh is arranged across a downstream end of the capillary channel, in particular across an inner cross-section of the capillary channel at a downstream end of the capillary channel, wherein the mesh forms at least a part of the evaporation section.

Example Ex14: The aerosol-generating arrangement according to example Ex14, wherein the mesh comprises or is made of at least one susceptor material.

Example Ex15: The aerosol-generating arrangement according to any one of examples Ex13 to Ex15, wherein the capillary channel is formed within a wall member of the aerosol-generating arrangement or by a capillary gap between several wall members of the aerosol-generating arrangement.

Example Ex16: The aerosol-generating arrangement according to any one of the preceding examples, wherein the capillary liquid conveyer comprises at least one capillary tube.

Example Ex17: The aerosol-generating arrangement according to any one of examples Ex13 to Ex17, wherein an inner cross-section of the capillary channel or the capillary tube varies, in particular increases, or is constant along a direction of fluid flow through the capillary channel or the capillary tube, respectively.

Example Ex18: The aerosol-generating arrangement according to any one of examples Ex13 to Ex18, wherein an inner cross-section of the capillary channel or the capillary tube is one of circular, oval, elliptical, rectangular or quadratic.

Example Ex19: The aerosol-generating arrangement according to any one of the preceding examples, wherein the capillary liquid conveyer comprises two opposing plates forming a capillary gap in between.

Example Ex20: The aerosol-generating arrangement according to example Ex20, wherein the two opposing plates are parallel to each other.

Example Ex21: The aerosol-generating arrangement according to any one of example Ex20 or example Ex21 wherein a width of the capillary gap between the two opposing plates in a direction perpendicular to the two opposing plates is in a range between 100 micrometers and 500 micrometers.

Example Ex22: The aerosol-generating arrangement according to any one of examples Ex20 to Ex22, wherein at least one of the two, preferably each of the two plates comprises one or more perforations at a downstream end portion of the capillary liquid conveyer forming the evaporation section.

Example Ex23: The aerosol-generating arrangement according to any one of examples Ex20 to Ex23, wherein at least one of the two, preferably each of the two plates comprises or is made of a susceptor material at least at a downstream end portion of the capillary liquid conveyer.

Example Ex24: The aerosol-generating arrangement according to any one of examples Ex20 to Ex24, wherein a gap holder is arranged at a downstream end of the capillary liquid conveyer covering the gap between the two opposing plates.

Example Ex25: The aerosol-generating arrangement according to any one of examples Ex20 to Ex25, wherein at least one of the two, preferably each of the two plates comprises or is made of a first material at a downstream end portion of the capillary liquid conveyer and a second material at an upstream end portion of the capillary liquid conveyer.

Example Ex26: The aerosol-generating arrangement according to any one of the preceding examples, wherein the capillary liquid conveyer comprises a capillary pipe having a downstream bell end forming the evaporation section, wherein preferably an inner cross-section of the capillary pipe may be constant or may vary, in particular may increase, along a direction of fluid flow through the capillary pipe.

Example Ex27: The aerosol-generating arrangement according to example Ex27, wherein the downstream bell end is angled with respect to the remainder of the capillary pipe.

Example Ex28: The aerosol-generating arrangement according to example Ex28, wherein the downstream bell end is angled by at least 45 degrees, in particular by at least 60 degrees, preferably by 90 degrees with respect to the remainder of the capillary pipe.

Example Ex29: The aerosol-generating arrangement according to any one of examples Ex27 to Ex29, wherein the capillary pipe with the downstream bell end has an alphorn-like shape.

Example Ex30: The aerosol-generating arrangement according to any one of examples Ex27 to Ex30, wherein the air jet generating member is arranged and configured to generate an air jet that passes in use tangentially past an outlet of the downstream bell end.

Example Ex31: The aerosol-generating arrangement according to any one of the preceding examples, wherein the evaporation section is or is located at a downstream end portion of the capillary liquid conveyer.

Example Ex32: The aerosol-generating arrangement according to any one of the preceding examples, wherein the capillary liquid conveyer is inductively heatable at least in the evaporation section.

Example Ex33: The aerosol-generating arrangement according to any one of the preceding examples, wherein the capillary liquid conveyer comprises or is made of a susceptor material at least in the evaporation section.

Example Ex34: The aerosol-generating arrangement according to any one of example Ex30 or example Ex31, further comprising an induction source configured and arranged to generate an alternating magnetic field at the position of the evaporation section.

Example Ex35: The aerosol-generating arrangement according to any one of the preceding examples, comprising a heating element in thermal contact with or thermal proximity to the evaporation section.

Example Ex36: The aerosol-generating arrangement according to example Ex36, wherein the heating element is a resistive heating element or an inductive heating element.

Example Ex37: The aerosol-generating arrangement according to any one of the preceding examples, wherein the air jet generating member is arranged and configured to generate an air jet that passes tangentially past an outlet or outlet portion of the capillary liquid conveyer.

Example Ex38: The aerosol-generating arrangement according to any one of the preceding examples, wherein the air jet generating member comprises at least one jet nozzle.

Example Ex39: The aerosol-generating arrangement according to any one of the preceding examples, wherein the air jet generating member comprises at least one air path constriction in the air duct.

Example Ex40: The aerosol-generating arrangement according to example Ex40, wherein the air jet generating member comprises an aperture plate forming the air path constriction.

Example Ex41: The aerosol-generating arrangement according to example Ex40, wherein the air duct comprises a guide wall whose distance to a length axis of the capillary liquid conveyer is smaller at the position of the evaporation section than at other positions in the air duct upstream and downstream the evaporation section, in particular proximately downstream and upstream the evaporation section, such that the air path constriction in the air duct is formed at the position of the evaporation section.

Example Ex42: The aerosol-generating arrangement according to example Ex40, wherein the air duct comprises a guide wall, wherein the air path constriction in the air duct is formed by a distance minimum between the guide wall and the capillary liquid conveyer at the position of the evaporation section.

Example Ex43: The aerosol-generating arrangement according to example Ex43, wherein the distance minimum is formed by a lateral widening, in particular a fanning of the capillary liquid conveyer in the evaporation section.

Example Ex44: The aerosol-generating arrangement according to any one of example Ex43 or example Ex44, wherein the distance minimum is formed by a lateral indentation of the guide wall at the position of the evaporation section.

Example Ex45: The aerosol-generating arrangement according to any one of the preceding examples, wherein the air duct comprises a guide sleeve having a varying cross-section along the sleeve length axis, wherein the evaporation section is located within the guide sleeve at a minimum of the cross-section such as to form the air jet generating member.

Example Ex46: The aerosol-generating arrangement according to example Ex46, wherein the guide sleeve comprises a funnel portion upstream the minimum.

Example Ex47: The aerosol-generating arrangement according to example Ex47, wherein in the funnel portion the cross-section of the guide sleeve tapers, in particular convexly tapers, towards the minimum as seen in a downstream direction of the airflow through the air duct.

Example Ex48: The aerosol-generating arrangement according to any one of examples Ex46 to Ex48, wherein the guide sleeve comprises a bulge portion downstream the minimum.

Example Ex49: The aerosol-generating arrangement according to example Ex49, wherein in the bulge portion the cross-section of the guide sleeve expands, in particular concavely expands, to a maximum and subsequently tapers, in particular concavely tapers, as seen in a downstream direction of the airflow through the air duct.

Example Ex50: An aerosol-generating article for use with an aerosol-generating device, the aerosol-generating article comprising an aerosol-generating arrangement according to any one of the preceding examples.

Example Ex51: An aerosol-generating system comprising an aerosol-generating article according to example Ex51, and an aerosol-generating device configured for use with the aerosol-generating article.

Example Ex52: An aerosol-generating device for generating an aerosol from an aerosol-forming liquid, wherein the device comprises an aerosol-generating arrangement according to any one of examples Ex1 to Ex50.

Examples will now be further described with reference to the figures in which.

Figure 1:
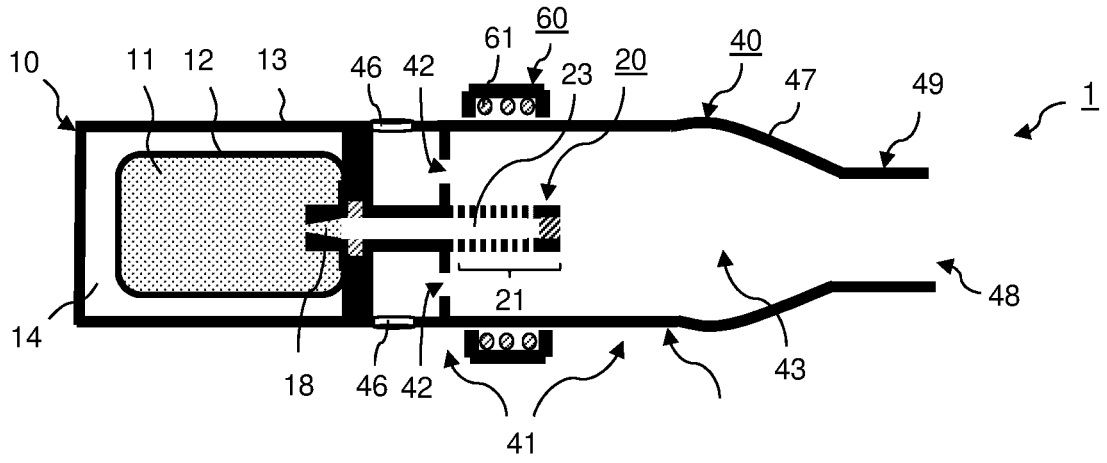
FIGS. 1-2 show an aerosol-generating arrangement according to a first exemplary embodiment of the present invention.
Figure 2:
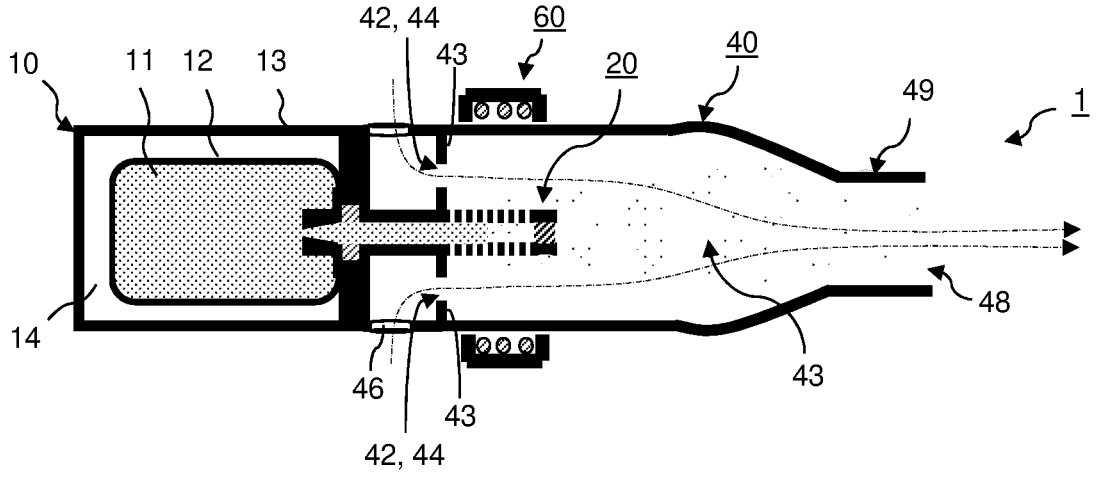

FIG. 1 and FIG. 2 schematically illustrate an aerosol-generating arrangement 1 for generating an inhalable aerosol from an aerosol-forming liquid 11 according to a first exemplary embodiment of the present invention. The aerosol-generating arrangement 1 comprises a liquid reservoir 10 for storing aerosol-forming liquid 11 and a capillary liquid conveyer 20 for conveying aerosol-forming liquid 11 from the liquid reservoir 10 via a reservoir orifice 18 to an evaporation section 21 of the liquid conveyer 20 outside the reservoir 10. There, the aerosol-forming liquid 11 may be vaporized by heating the evaporation section 21. The vaporized liquid is exposed to air flowing past the evaporation section through an air duct 40 which is formed by a bottle-shaped guide sleeve 47 surrounding the liquid conveyer 20. The vaporized liquid is mixed with air such as to form an aerosol which may be subsequently drawn out, for example, via a mouthpiece 49 of the air duct 40. The aerosol-generating arrangement 1 is configured such that the airflow through the air duct 40 is caused by a user's puff, that is, by a user taking a puff at the downstream end of the air path through the air duct 40. The air path through the air duct is indicated by dashed-dotted lines in FIG. 2. The downstream end of the air duct 40 is formed by an outlet 48 in the mouthpiece 49. Thus, when a user takes a puff, low pressure is induced at the outlet 48 which in turn causes air to enter the air duct 40 via inlets 46 which form the upstream end of the air path through the air duct 40.

Figure 3:
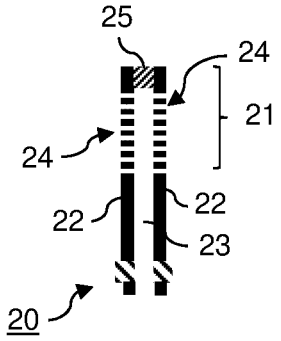
FIGS. 3-4 show details of the liquid conveyer as used in the aerosol-generating arrangement according to FIGS. 1-2.
Figure 4:
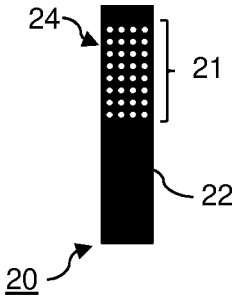
Figure 5:
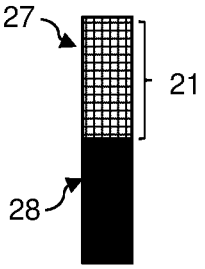
FIG. 5 shows another embodiment of the liquid conveyer which can be alternatively used in the aerosol-generating arrangement according to FIGS. 1-2.

In the embodiment shown in FIG. 1 and FIG. 2, the capillary liquid conveyer 20 comprises two opposing plates 22 forming a capillary gap 23 in between. Details of this double-plate liquid conveyer 20 are shown in FIG. 3 and FIG. 4. The width of the capillary gap 23 between the two opposing plates 22 in a direction normal to the two opposing plates 22 is within capillary ranges, for example, in a range between 100 micrometers and 500 micrometers. In particular, the width of the capillary gap 23 is constant along a direction of fluid flow through the capillary gap. That is, the two opposing plates 22 preferably are parallel to each other. A gap holder 25 is arranged at a downstream end of the liquid conveyer 20 which serves to keep the two plates 22 separate from each other and to close the gap 23 at the downstream end of the liquid conveyer 20. Each of the two plates 22 comprises a plurality of perforations 24 (through holes) at the downstream end portion of the capillary liquid conveyer 22 which forms the evaporation section 21. The perforations 24 have a diameter within capillary ranges such the aerosol-forming liquid can form a meniscus in the opening of each perforations. The two plates 22 are made of a susceptor material, for example, stainless steel, thus allowing the plates 22 to be inductively heated. Due to this, the double-plate liquid conveyer 20 is capable to perform two functions, conveying and heating aerosol-forming liquid. For heating the liquid conveyer, an induction source 60 including an induction coil 61 may be arranged around the air duct 40 as shown in FIG. 1 and FIG. 2, in order to generate an alternating magnetic field. The induction coil 61 is arranged at about the position of the evaporation section 21 such as to generate an alternating magnetic field which locally penetrates the liquid conveyer 20 at the evaporation section 21 only. As a consequence, the liquid conveyer 20 is locally heated in the evaporation section 21 only. The field strength may be chosen such that the evaporation section 21 is heated up to temperatures sufficient to vaporize the aerosol-forming liquid conveyed through the liquid conveyer 20 to the perforations 24. There, vaporized liquid may escape through the perforations 24 into the airflow passing past the evaporation zone 21. Due to the local heating, the remaining sections of the liquid conveyer 20 may stay at temperatures below the vaporization temperature. Hence, in use the liquid conveyer 20 comprises a temperature profile along its length direction which shows a temperature increase from temperatures below the vaporization temperature of the aerosol-forming liquid (at the upstream end portion of the liquid conveyer 20) to temperatures above the vaporization temperature (at the downstream end portion of the liquid conveyer 20). Advantageously, having the remaining sections below the vaporization temperature prevents boiling of aerosol-forming liquid within the liquid conveyer 20 upstream the evaporation section 21 and also within the liquid reservoir 10. Due to the small dimensions of the capillary gap 23 and the perforations 24, only a small amount of liquid is present in the evaporation section 21. Advantageously, this allows for flash heating, that is, for a fast onset of evaporation FIG. 5 shows an alternative embodiment of the double-plate liquid conveyer. Here, each of the plates is two-part plate comprising a first plate element 27 at a downstream end portion of the liquid conveyer 20 and a second plate element 28 at an upstream end portion of the liquid conveyer. While the second plate element 28 is an unperforated plate with a closed surface, the first plate element 27 is a mesh plate forming the evaporation section 21. The material of the mesh plate 27 is a susceptor material, that is, inductively heatable. In contrast, a material of the second plate element 28 preferably is electrically non-conductive and non-magnetic, thus inductively non-heatable. Advantageously, this two-part configuration helps to locally delimit the heated portion of the liquid conveyer 20 to the evaporation section 21.

As mentioned above, using capillary liquid conveyers comes with problems inherent to the processes governing the physics of capillary action. In particular, this concerns the uncontrolled imbibition of the capillary liquid conveyer which in turn may cause undesired leakage problems and variations in the amount of liquid available in the evaporation section. In order to have a better control of the liquid flow rate through the liquid conveyer 20 the aerosol-generating arrangement 1 according to the present invention is configured to generate an inhalation induced pressure drop of the static pressure in the vicinity of the evaporation section. This pressure drop causes liquid to be drawn from the reservoir 10 through the capillary liquid conveyer 20 to the evaporation section 21. The pressure drop is induced by an air jet generated in an ejector portion 41 of the air duct 40 which comprises an air jet generating member 42 and an expansion zone 43 downstream the air jet generating member 41. In the embodiment shown in FIG. 1 and FIG. 2, the air jet generating member 42 comprises an aperture plate 43 arranged within the airflow path of the air duct having an aperture 44 at each side of the double-plate liquid conveyer 20. A cross-section of each aperture 44 is smaller than a cross-section of the air path through the air duct 40 downstream and upstream the respective aperture 44. Thus, each aperture 44 forms an air path constriction in the air duct 40. While passing through the apertures 44, air speeds up as a result of mass conservation, thus causing an air jet downstream the apertures 44 at each side of the double-plate liquid conveyer 20 which induces a drop of the static pressure in the vicinity of the evaporation section 21. The physical mechanism behind the static pressure drop as seen from a microscopic view is as follows: Fast moving air particles in the air jet ejecting into open atmosphere downstream the apertures 44 collide with air particles that are randomly and slowly wandering around. Collision pushes the "stationary" air particles further away leading to local pressure drops which in turn results in more air particles being drawn into the air jet from the surroundings. Thus, the air jet leaves behind a partial a vacuum which is felt as a pressure drop inside the liquid conveyer 20, thus causing a pressure gradient along the capillary liquid conveyer 20 that draws liquid out of the reservoir 10 through the capillary gap 23 to the evaporation section 21. The air jet further causes aerosol-forming liquid 11 vaporized at the evaporation section 21 to be drawn into the airflow and subsequently to be mixed with air in the expansion zone 43 downstream the air jet generating member such as to form an aerosol. As mentioned above, the airflow driven pressure drop and thus the flow of liquid through the capillary liquid conveyer 20 is triggered by a user inhalation which the airflow through the air duct 40. In particular, the liquid flow rate from the reservoir 10 through the capillary liquid conveyer 40 to the evaporation section 21 may be specifically controlled by a user by varying the intensity of the user inhalation. In order to prevent uncontrolled imbibition of the capillary liquid conveyer 20, in particular when the aerosol-generating arrangement 1 is out of use, the liquid reservoir 10 is a so-called volume compensating reservoir which is configured to provide a restoring force which holds back capillary imbibition, that is, which is configured to counteract the capillary suction and the liquid static pressure that would otherwise cause leakage through the liquid conveyer 20. Together the volume compensating liquid reservoir 10 and the air jet generating member 42 form a well-balanced system which on the one hand suppresses uncontrolled imbibition and thus provides leakage protection, and on the other hand allows for an enhanced control over the liquid flow rate through the capillary liquid conveyer 20. In the embodiment shown in FIG. 1 and FIG. 2, the volume compensating liquid reservoir 10 is realized by a reservoir which comprises a flexible bag 12 for storing the aerosol-forming liquid 11 and a low-pressure chamber 13 sealingly enclosing the flexible bag 12. The interior of the flexible bag is in fluid communication with the capillary liquid conveyer 20 via the reservoir orifice 18, while the exterior of the flexible bag 12 is exposed to the pressure inside the sealed space between the flexible bag 12 and the surrounding chamber. As shown in FIG. 1, the pressure within the low-pressure chamber 13 is chosen to be lower than ambient pressure, in particular atmospheric pressure, minus the sum of the static liquid pressure and the capillary pressure at an upstream end of the reservoir orifice 18. Advantageously, this helps to counteract the capillary suction of the liquid conveyer 20 and thus to prevent liquid 11 from leaking out of flexible bag 12, when the system is out use and no pressure drop is present in the vicinity of the evaporation section. Vice versa, as shown in FIG. 2, when air is flowing through the air jet generating member 41 during a user inhalation that causes a pressure drop in the vicinity of the evaporation section 21 being larger than the sum of the static liquid pressure and the capillary pressure, the pressure within the low-pressure chamber 13 beats the downstream pressure. As a consequence, a pressure gradient is generated along the capillary liquid conveyer 20 in the downstream direction that draws liquid 11 out of the flexible bag 12 through the capillary liquid conveyer 20 to the evaporation section 21. Upon disappearance of the external pressure drop after the end of a user inhalation, liquid 11 remaining inside the capillary liquid conveyer 20 is pushed back into the flexible bag 12 by ambient pressure, in particular atmospheric pressure, until the system finally reaches an equilibrium state shown. Due to the liquid extraction, the flexible bag 12 collapses by a volume equal to that of the liquid extracted from the reservoir 10. Preferably, the flexible bag 12 is made from fluid-impermeable plastic. In contrast, the low-pressure chamber preferably comprises rigid walls. That is, the low-pressure chamber preferably is a rigid-wall chamber. Due to this, the low-pressure chamber can maintain the low pressure inside and resist deformation from inside as well as from outside. For example, the walls of the low-pressure chamber may be made of plastic, in particular a silicone, PP (polypropylene), PE (polyethylene) or PET (polyethylene terephthalate).

Figure 6:
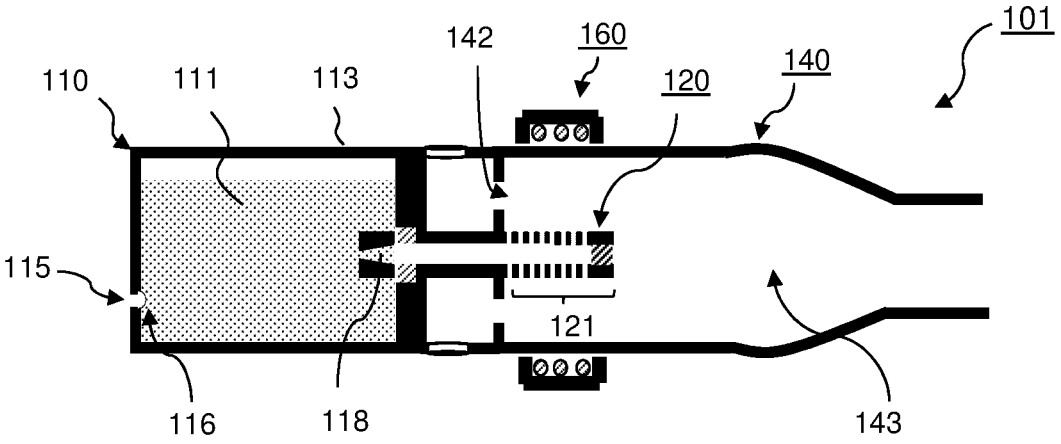
FIG. 6 shows an aerosol-generating arrangement according to a second exemplary embodiment of the present invention.

FIG. 6 schematically illustrates an aerosol-generating arrangement 101 according to a second exemplary embodiment of the present invention. The arrangement 101 shown in FIG. 6 is similar to the arrangement 1 shown FIG. 1 and FIG. 2. Therefore, identical or similar features are denoted with the same reference signs, yet incremented by 100. In contrast to the arrangement 1 shown FIG. 1 and FIG. 2, the aerosol-generating arrangement 101 shown in FIG. 6 comprises a volume compensating liquid reservoir 110 which is a rigid-wall chamber 113 comprising a breather hole 115. The breather hole 115 has a size within the capillary range enabling aerosol-forming liquid 111 in the liquid reservoir 110 to form a meniscus 116 towards the interior of the liquid reservoir 110. The meniscus 116 provides resistance to the surface tension that drives the liquid through the capillary liquid conveyer 120. The meniscus 116 deforms much like the shape of a bulged membrane, until the liquid tension at the reservoir orifice 118 is balanced. The resistance to volume change scales inversely with the size of the opening. Preferably, a cross-sectional area of the breather hole 115 is smaller than a maximum cross-sectional area of the reservoir orifice 118. For example, the breather hole 115 may have a size in a range between 0.05 millimeter and 3 millimeter, in particular between 0.05 millimeter and 1.5 millimeter, preferably between 0.05 millimeter and 1 millimeter.

Figure 7:
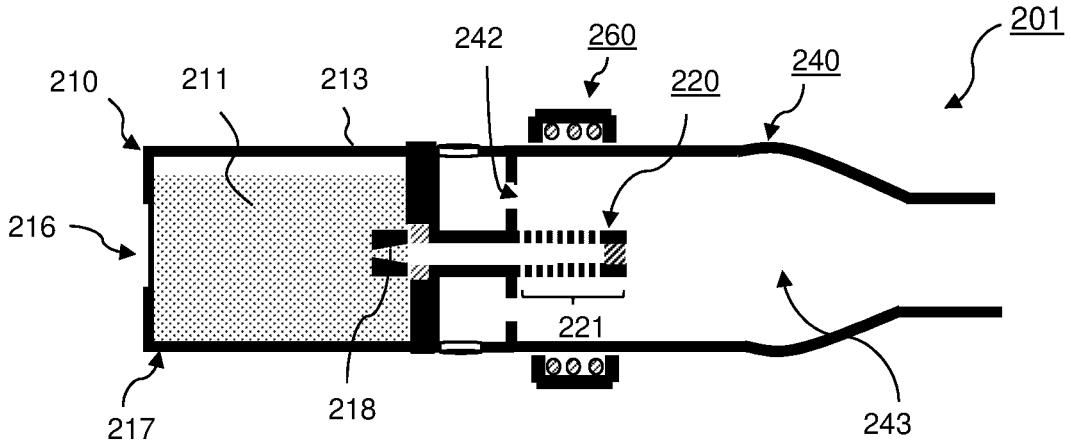
FIGS. 7-8 show an aerosol-generating arrangement according to a third exemplary embodiment of the present invention.
Figure 8:
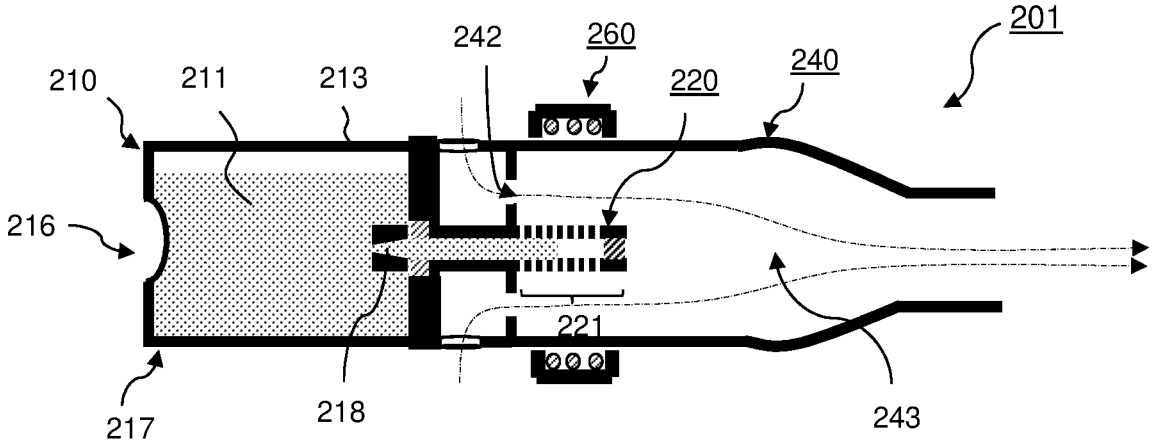

Instead of merely relying on the elastic properties of the meniscus formed by the liquid in a breather hole, the hole may be covered with a resilient diaphragm that can deform under pressure load. Using a resilient diaphragm may also allow to increase the size of the breather hole beyond capillary ranges. This is shown in FIG. 7 and FIG. 8 which schematically illustrate an aerosol-generating arrangement 201 according to a third exemplary embodiment of the present invention. Due to its similarity to the arrangement 1 shown FIG. 1 and FIG. 2, identical or similar features are again denoted with the same reference signs, yet incremented by 200. In contrast to the arrangement 1 shown FIG. 1 and FIG. 2, the aerosol-generating arrangement 201 shown FIG. 7 and FIG. 8 comprises a volume compensating liquid reservoir 210 having a resilient diaphragm 216 forming a wall member of the liquid reservoir 210. All other wall members 217 of the liquid reservoir 210 are rigid wall members. The resilient diaphragm 216 is made of a thin rubber membrane which is exposed to the interior of the liquid reservoir at its inside and to ambient pressure, in particular atmospheric pressure, at its outside. Like the meniscus 116 in FIG. 6, the resilient diaphragm 216 provides resistance to the surface tension that drives the liquid through the capillary liquid conveyer 220. In particular, as shown in FIG. 7, when the system is out use and no pressure drop is present in the vicinity of the evaporation section 221, the resistance provided by the resilient diaphragm 216 prevents liquid 211 from leaking out of the reservoir 210. When a user takes puff and thus induces a pressure drop in the vicinity of the evaporation section 221, the resilient diaphragm 216 deforms until the pressure drop is balanced, as shown in FIG. 8. The resistance provided by the resilient diaphragm 216 depends on its Young's modulus. For example, the resilient diaphragm may have a Young's modulus (modulus of elasticity in tension) in a range between 1 MPa (Mega-Pascal) and 100 MPa (Mega-Pascal), in particular between 2 MPa (Mega-Pascal) and 50 MPa (Mega-Pascal), preferably between 2 MPa (Mega-Pascal) and 20 MPa (Mega-Pascal).

Each of the liquid reservoirs 10, 110, 210 shown in FIGS. 1, 2, 6, 7 and 8 comprises a reservoir orifice 18, 118, 218 which the respective capillary liquid conveyer 20, 120, 220 is in fluid communication with. The reservoir orifices 18, 118, 218 may have a varying cross-section along the direction of fluid flow through the reservoir orifice. This may help, for example, to counteract the changes in the liquid static pressure due to changes in the orientation of the device. Preferably, the cross-section of the reservoir orifice tapers in an upstream direction, that is, towards the interior of the liquid reservoir.

FIGS. 9-16 show various embodiments of the air duct and the capillary liquid conveyer being alternatives to the air ducts and the capillary liquid conveyers shown in FIGS. 1-8. Features being identical or similar are denoted with the same reference signs incremented by multiples of 100.

Figure 9:
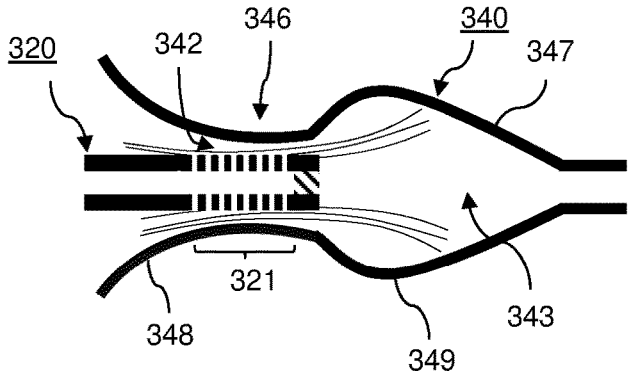
FIGS. 9-16 show various embodiments of the air duct and the capillary liquid conveyer being alternatives to the air duct and the capillary liquid conveyer shown in FIGS. 1-8.

In FIG. 9, the capillary liquid conveyer 320 is identical to the double-plate liquid conveyer 20 of the aerosol-generating arrangement shown in FIGS. 1-2. In contrast to the arrangement 1 shown in FIGS. 1-2, the air duct 340 shown in FIG. 9 comprises a guide sleeve 347 having a varying cross-section along the sleeve length axis, in particular in a portion surrounding the liquid conveyer 320. The evaporation section 321 is located within the guide sleeve 347 at a minimum 346 of the cross-section of the guide sleeve 347. Accordingly, the cross-section of the air path between the guide sleeve 347 and the evaporation section is constricted, thus forming an air jet generating member 342. That is, the air jet generating member 342 is realized by a distance minimum between the wall of the guide sleeve 347 and the capillary liquid conveyer 320 at the position of the evaporation section 321. In other words, the air jet generating member 342 is realized by a lateral indentation of a guide wall of air duct 340 at the position of the evaporation section 321, wherein the lateral indentation of the guide wall points towards the capillary liquid conveyer 320. In the present embodiment, the guide sleeve 347 comprises a funnel portion 348 upstream the minimum 346. In the funnel portion 348, the cross-section of the guide sleeve 347 convexly tapers towards the minimum 346 as seen in a downstream direction of the airflow through the air duct 340. The guide sleeve 347 further comprises a bulge portion 349 downstream the minimum 346. In the bulge portion 349, the cross-section of the guide sleeve 347 first expands concavely and subsequently tapers concavely as seen in a downstream direction of the airflow through the air duct 340. The bulge portion 349 forms the expansion zone 343 of the ejector portion. The guide sleeve 347, in particular the funnel portion 348, is formed and arranged such as to generate an air jet that passes tangentially past the perforations in the evaporation section 321 of the liquid conveyer 320.

Figure 10:
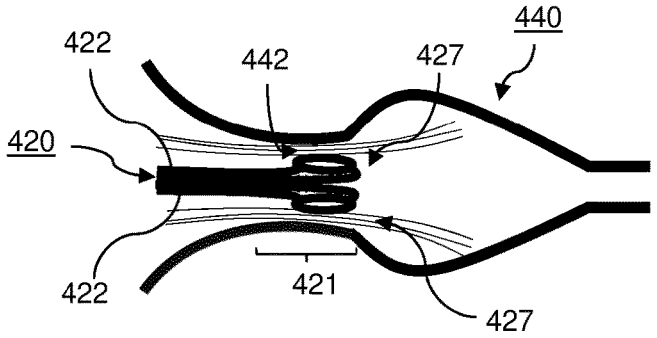

In FIG. 10, the air duct 440 is identical to the air duct 340 shown in FIG. 9. In contrast to FIG. 9, the aerosol-generating arrangement shown in FIG. 10 comprises a liquid conveyer 420 that is realized by two capillary pipes 422. Each capillary pipe 422 has an open-ended downstream bell end 427 forming the evaporation section 421. An inner cross-section of the capillary pipes 422 increases along the direction of fluid flow through the capillary pipe 422. Advantageously, the increasing cross-section makes a separate varying cross-section of the reservoir orifice unnecessary. The downstream bell end 427 is angled by 90 degrees with respect to the remainder of the respective capillary pipe 422 such that the outlet of the downstream bell end 427 (where the aerosol-forming liquid is evaporated in use) is tangential to the air jet generated by the air jet generating member 442 flowing past the evaporation section 421. Due to the angled downstream bell ends 427, the capillary pipes 422 have an alphorn-like shape. Like the double-plate liquid conveyer, the capillary pipes 422 preferably are inductively heatable at least at the respective downstream bell end 427.

Figure 11:
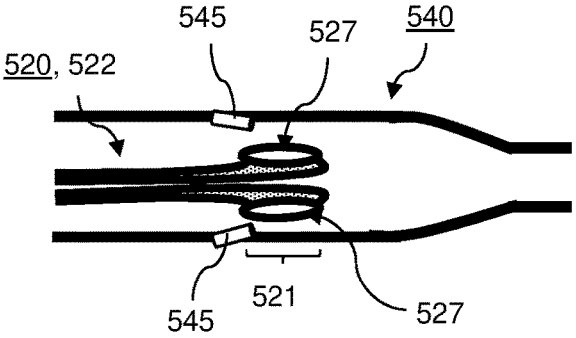

In FIG. 11, the liquid conveyer 520 is identical to the alphorn-like liquid conveyer 420 shown in FIG. 10. In contrast to FIG. 10, the aerosol-generating arrangement shown in FIG. 11 comprises an air duct 540 with a constant cross-section in the portion surrounding the evaporation section 521. Instead of a lateral indentation of a guide wall of the air duct, the air jet generating member 542 of the arrangement according to FIG. 11 comprise two jet nozzles 545 configured to generate an air jet for each of the alphorn-like liquid conveyer 520. Each air jet is an additional airflow path entering the main airflow path through the air duct 540 at a favourable position about the evaporation section 521 so to generate a pressure drop in the vicinity of the evaporation section 521. The two jet nozzles 545 are configured and arranged such that the respective air jet is essentially tangential to the outlet of the downstream bell end 527 of the associated alphorn-like capillary pipe 522.

Figure 12:
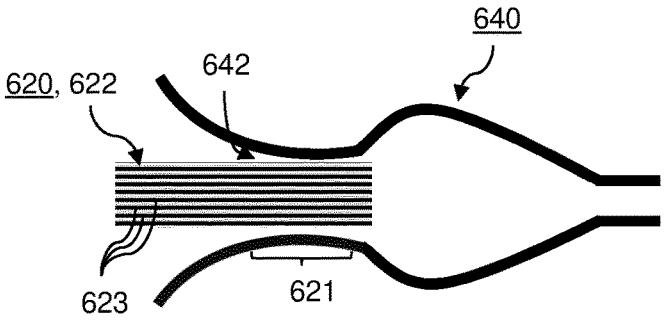

In FIG. 12, the air duct 640 is identical to the air ducts 340, 440 shown in FIG. 9 and FIG. 10. In contrast to FIG. 9 and FIG. 10, the aerosol-generating arrangement shown in FIG. 12 comprises a liquid conveyer 620 that is realized by an unstranded filament bundle 622 including a plurality of filaments 623 arranged parallel to each other. The filaments 623 or at least a part of the filaments 623 may be made of a susceptor material, thus allowing the liquid conveyer 620 to be inductively heated by an induction source. Preferably, the induction source is configured and arranged to generate an alternating magnetic field substantially only at the position of the evaporation section 621. Advantageously, this results in the filament bundle 622 to be heated locally in the evaporation section 621 only.

Figure 13:
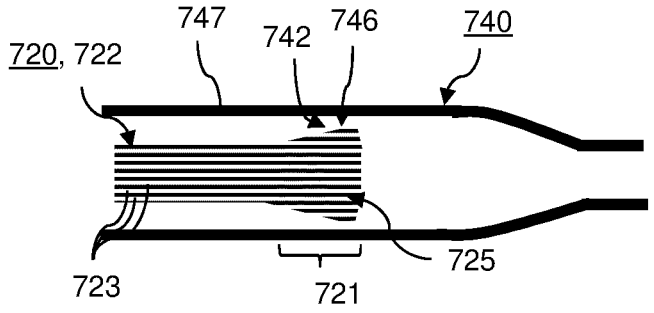

Like in FIG. 12, the aerosol-generating arrangement shown in FIG. 13 comprises a liquid conveyer 720 that is realized by a filament bundle 722. In contrast to FIG. 12, the filament bundle 722 comprises a fan-out portion 725 at a downstream end portion of the filament bundle 722, in which the filaments 723 diverge from each other. Preferably, the fan-out portion 725 corresponds the evaporation section 721. In the fan-out portion 725. The fan-out portion 725 may prove beneficial to facilitate the exposure of the vaporized aerosol-forming liquid into the air path and thus to facilitate the formation of an aerosol. In addition, due to the fan-out portion 725, there is a distance minimum 746 between the sleeve-like guide wall 747 of the air duct 740 and the downstream end portion of the filament bundle 722. The distance minimum 746 forms an air path constriction realizing an air jet generating member 742 that causes the desired pressure drop at the downstream end portion of the filament bundle 722, that is, at the evaporation section 721.

Figure 14:
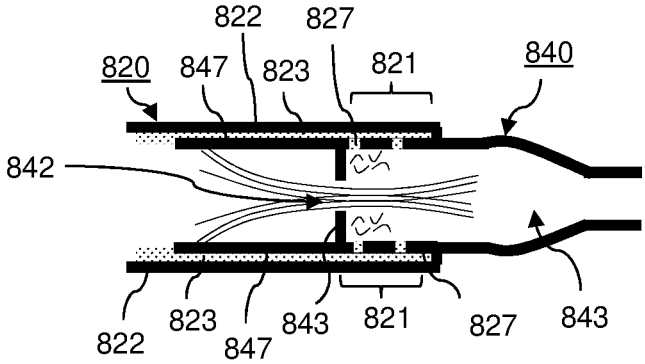
Figure 15:
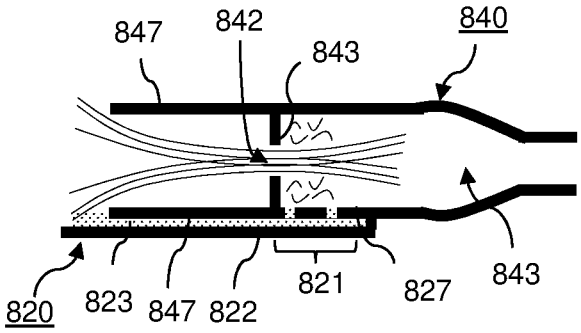

FIG. 14 and FIG. 15 show further embodiments of the aerosol-generating arrangement having a central air duct 840 as well as a capillary liquid conveyer 820 at the outside of the air duct 840 which comprises a capillary channel 823. In both embodiments, the respective central air duct 840 comprises an aperture plate 843 similar to the aperture plate shown in FIG. 1 and FIG. 2, which forms the air jet generating member 842. As can be further seen in FIG. 14 and FIG. 15, the capillary channel 823 is formed by a capillary gap between an inner wall member 847 forming part of the central air duct 840 and an outer wall member 822 forming, for example, an outer housing of the aerosol-generating arrangement. While the embodiment according to FIG. 14 comprises two capillary channels 823, one at each side of the central air duct 840, the embodiment according to FIG. 15 comprises a single lateral capillary channel 823 only. A mesh 827 made of a susceptor material is arranged across the downstream end of each capillary channel 823 such as to form an inductively heatable evaporation section 821. The size of the interstices of the mesh 827 is chosen such that the aerosol-forming liquid can form a meniscus therein. For example, the width of the interstices is between 75 micrometer and 250 micrometer. In use, aerosol-forming liquid vaporized mesh 827 is drawn into the airflow downstream the aperture plate 843 where it is mixed with air in the expansion zone 843 such as to form an aerosol.

Figure 16:
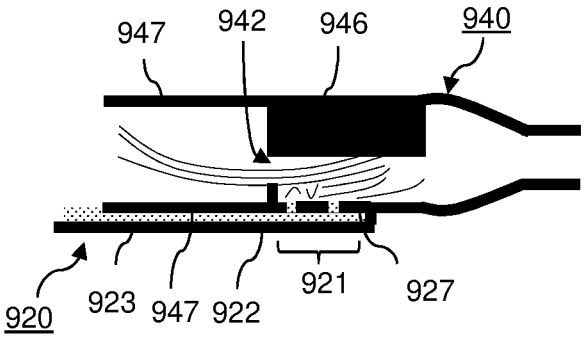

FIG. 16 shows yet another embodiment of the aerosol-generating arrangement which is similar to the aerosol-generating arrangement shown in FIG. 15. Therefore, identical or similar features are denoted with the same reference signs, yet incremented by 100. In contrast to the arrangement shown in FIG. 15, the arrangement shown in FIG. 16 does not comprise an aperture plate, but a block element 946 which forms an air path constriction of the air path through the air duct 940. The air path constriction constitutes an air jet generating member 942 which generates an air jet flowing past the evaporation section 921, thus causing a drop of the static air pressure in the vicinity of the evaporation section 921 which draws aerosol-forming liquid through the capillary channel 823 of the capillary liquid conveyer 920 to the evaporation section 921.

For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A ±5 percent of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating arrangement for generating an aerosol from an aerosol-forming liquid, the aerosol-generating arrangement comprising:

a liquid reservoir configured to store aerosol-forming liquid;

a capillary liquid conveyer configured to convey aerosol-forming liquid from the liquid reservoir via a reservoir orifice to an evaporation section of the capillary liquid conveyer outside the liquid reservoir; and an air duct configured to pass an airflow past the evaporation section, wherein the liquid reservoir is a volume-compensating liquid reservoir configured to counteract capillary imbibition of the capillary liquid conveyer, wherein the air duct comprises an ejector portion including an air jet generating member and an expansion zone downstream the air jet generating member, and wherein the air jet generating member is arranged and configured to generate an air jet in the airflow through the air duct causing a drop of static air pressure in a vicinity of the evaporation section.

2. The aerosol-generating arrangement according to claim 1, wherein the volume-compensating liquid reservoir comprises a flexible bag configured to store aerosol-forming liquid and a low-pressure chamber sealingly enclosing the flexible bag, and wherein an interior of the flexible bag is in fluid communication with the capillary liquid conveyer.

3. The aerosol-generating arrangement according to claim 2, wherein a pressure within the low-pressure chamber acting on an exterior of the flexible bag is lower than ambient pressure minus a sum of a static liquid pressure and a capillary pressure at an upstream end of the capillary liquid conveyer.

4. The aerosol-generating arrangement according to claim 3, wherein the ambient pressure is atmospheric pressure.

5. The aerosol-generating arrangement according to claim 1, wherein the volume-compensating liquid reservoir comprises a rigid-wall chamber comprising at least one breather hole having a size enabling aerosol-forming liquid in the liquid reservoir to form a meniscus towards an interior of the liquid reservoir.

6. The aerosol-generating arrangement according to claim 5, wherein a cross-sectional area of the breather hole is smaller than a largest cross-sectional area of the reservoir orifice.

7. The aerosol-generating arrangement according to claim 1, wherein the volume-compensating liquid reservoir comprises at least one resilient diaphragm forming an outer wall member of the liquid reservoir.

8. The aerosol-generating arrangement according to claim 7, wherein any other wall member of the liquid reservoir apart from the at least one resilient diaphragm is a rigid wall member.

9. The aerosol-generating arrangement according to claim 1, wherein the capillary liquid conveyer comprises at least one capillary channel, wherein a mesh is arranged across a downstream end of the capillary channel, and wherein the mesh forms at least a part of the evaporation section.

10. The aerosol-generating arrangement according to claim 9, wherein the mesh is arranged across an inner cross-section of the capillary channel at a downstream end of the capillary channel.

11. The aerosol-generating arrangement according to claim 9, wherein the capillary channel is formed within a wall member of the aerosol-generating arrangement or by a capillary gap between several wall members of the aerosol-generating arrangement.

12. The aerosol-generating arrangement according to claim 1, wherein the capillary liquid conveyer comprises two opposing plates forming a capillary gap in between.

13. The aerosol-generating arrangement according to claim 12, wherein at least one of the two of the two plates comprises one or more perforations at a downstream end portion of the capillary liquid conveyer forming the evaporation section.

14. The aerosol-generating arrangement according to claim 12, wherein each of the two plates comprises one or more perforations at a downstream end portion of the capillary liquid conveyer forming the evaporation section.

15. The aerosol-generating arrangement according to claim 1, wherein the capillary liquid conveyer comprises a capillary pipe having a downstream bell end forming the evaporation section.

16. The aerosol-generating arrangement according to claim 15, wherein an inner cross-section of the capillary pipe varies along a direction of fluid flow through the capillary pipe.

17. The aerosol-generating arrangement according to claim 15, wherein an inner cross-section of the capillary pipe increases along a direction of fluid flow through the capillary pipe.

18. The aerosol-generating arrangement according to claim 15, wherein the downstream bell end is angled with respect to a remainder of the capillary pipe.

19. The aerosol-generating arrangement according to claim 1, wherein the capillary liquid conveyer is inductively heatable at least in the evaporation section.

20. The aerosol-generating arrangement according to claim 1, wherein the air jet generating member is further arranged and configured to generate an air jet that passes tangentially past an outlet or outlet portion of the capillary liquid conveyer.

* * * * *